US005529928A

United States Patent [19]

Ciampi et al.

[11] Patent Number: 5,529,928

[45] Date of Patent: Jun. 25, 1996

[54] ENZYMATIC TREATMENT OF WOOL

[75] Inventors: Luigi Ciampi, Basle; Otto Forster; Hans R. Haefely, both of Zurich, all of Switzerland; Franz Knauseder, Kirchbiehl, Austria

[73] Assignee: Schoeller Hardtrum AG, Zurich, Switzerland

[21] Appl. No.: 472,410

[22] Filed: Jun. 6, 1995

Related U.S. Application Data

[63] Continuation of Ser. No. 293,975, Aug. 19, 1994, abandoned, which is a continuation of Ser. No. 172,697, Dec. 19, 1993, abandoned, which is a continuation of Ser. No. 750,336, Aug. 27, 1991, abandoned, which is a continuation of Ser. No. 427,653, Oct. 26, 1989, abandoned, which is a continuation-in-part of Ser. No. 372,411, Jun. 27, 1989, abandoned, filed as PCT/EP88/00971 Oct. 27, 1988.

[30] Foreign Application Priority Data

Oct. 28, 1987 [CH] Switzerland ..... 04214/87

[51] Int. Cl.[6] ..... C12S 3/00; C12S 11/00; D01C 3/00; D06M 10/00

[52] U.S. Cl. ..... 435/263; 435/262; 8/112; 8/127.5; 8/127.51; 8/127.6; 8/128.1; 8/115.52

[58] Field of Search ..... 435/262, 263; 8/112, 127.5, 127.51, 227.6, 128.1, 115.52

[56] References Cited

U.S. PATENT DOCUMENTS

| | | | |
|---|---|---|---|
| 3,616,232 | 10/1971 | Anderson | 195/66 R |
| 4,019,956 | 4/1977 | Saby | 195/6 |
| 4,177,176 | 12/1979 | Burrull et al. | 428/447 |
| 4,260,686 | 4/1981 | Asbeck et al. | 435/265 |
| 4,403,011 | 9/1983 | Shelly et al. | 428/264 |
| 4,533,359 | 8/1985 | Kondo et al. | 8/128 |

FOREIGN PATENT DOCUMENTS

| | | |
|---|---|---|
| 134267 | 8/1989 | European Pat. Off. . |
| 344250 | 5/1993 | European Pat. Off. . |

OTHER PUBLICATIONS

WO 8903909 (May 5, 1989) (Abstract).

JP 58144105 A2 (Aug. 27, 1983) (Abstract).

Chemical Abstracts vol. 68 (18) 79457q 1966.

Chemical Abstracts vol. 107 (18): 156223p. 1986.

IWS Test Method 31 Jan. 1983 pp. 1–12.

IWS Test Method 185 Aug. 1980 pp. 1–6.

*Primary Examiner*—Donald E. Czaja
*Assistant Examiner*—Timothy J. Reardon
*Attorney, Agent, or Firm*—Robert S. Honer; Carl W. Battle; Michael P. Morris

[57] ABSTRACT

The invention relates to a process for the production of wool and animal hairs with a low-in felt or felt-free finish, with a soft woolly handle and special shrink-resistance and strength. In this process, the wool is treated with a protease and is then treated at a temperature of between room temperature and 140° C.

21 Claims, No Drawings

ENZYMATIC TREATMENT OF WOOL

This is a continuation of application Ser. No. 08/293,975, filed Aug. 22, 1994, which in turn is a continuation of application Ser. No. 08/172,697, filed Dec. 23, 1993, which in turn is a continuation of application Ser. No. 07/750,336, filed Aug. 27, 1991, which in turn is a continuation of application Ser. No. 07/427,653, filed Oct. 26, 1989, the latter four of which are now abandoned, which in turn is is a continuation-in-part of application Ser. No. 07/372,411, filed Jun. 27, 1989, now abandoned, which in turn is a continuation-in-part of International Application No. PCT/EP 88/00971, filed Oct. 27, 1988.

The present invention relates to a process for the production of wool and animal hairs with a low-in-felt or felt-free finish and to the wool or animal hairs so obtained.

To obtain felt-free wool has been a problem for many years and many methods including enzymatic treatments have been proposed to solve this problem. A review of such methods has been published by E. P. Frieser in Textil-Praxis, 18 (1963, 03), pages 236–240 and he refers back to articles by W. R. Middlebrook and H. Phillips in J. Soc. Dyers and Colorists, 57 (1941), pages 137–144 and A. N. Davidson and R. Preston in J. Text. Inst. 47 (1956), pages 685–707 (also described in Belgian Patent No. 536 819). Although not always as explicitly stated as in European Patent Application 134 267, the object of these enzymatic treatments was to achieve a complete descaling of the wool, i.e. that the outer surface of the fibres is totally removed and the character of the fibres changed in such a way that the natural aspect of the wool is lost.

The object of the present invention is to produce wool and animal hairs which keep their natural aspect and still have scales, but are low-in-felt or felt-free. This object is achieved by an enzymatic treatment which, in contrast to the known treatments, is superficial and short but effective to obtain a product that can be washed without negative consequences in ordinary household washing machines. A reliable method to differentiate this product from natural wool is the IWS Test Method 31, published by the International Wool Secretariat. Whereas the untreated fibres start to felt at the latest after 3 cycles of the described 7 A washes, the enzymatically treated wool according to the invention can stand at least 5 of these cycles and, depending on the form of the material, may even stand 2 to 5 cycles of the 5 A washes according to said test method without felting.

Another method to determine whether the wool fibres can be called felt-free is the well known Cubex-Test according to IWS Test Method 185, in which the shrinkage properties of wool are determined by treatment for one hour in cube form in a standardised washing appliance. In this test the wool should have an area shrinkage of <10% after a Cubex test lasting at least one hour. By area shrinkage is understood the sum of the % shrinkage in length and of the % shrinkage in width. This corresponds to about 15–20 machine washes at high speed in a domestic washing machine without shrinkage and without significant alteration to the surface and shape.

Furthermore, the yarn strength of the treated wool should, compared with untreated wool, be lost by less than 15% and the elongation should deteriorate by less than 20%.

The invention, therefore, relates to a process for the production of wool or protein containing animal hair having (in addition to a soft handle and a natural appearance) a low-in-felt or felt-free finish which comprises applying a protease to the wool or hair and subsequently treating the thus-treated wool or hair at a temperature between 20° C. and 140° C. for a sufficient time to impart the following properties:

a) an area shrinkage of <10% after a Cubex test according to IWS TM185 lasting at least one hour or after 5 cycles 7 A, preferably after 2 cycles 5 A, according to IWS TM 31, b) a loss of yarn strength, compared with the untreated wool or hair, of less than 15%, and c) a loss of stretching (elongation) of less than 20%, compared with the untreated wool or hair.

By protease is understood any protein-splitting enzyme. Suitable proteases are enzymes recovered from bacteria, for example, subtilisin, thermolisin, as well as enzymes from animal or plant origin, for example trypsin, pepsin, pancreatin or bromelain. Mixtures of various enzymes can also be used. These proteases are available commercially. Preferred proteases for the process according to the invention are the animal and vegetable enzymes, especially bromelain.

The effectiveness of the enzyme employed can be increased by adding specific activators such as cystein, dithioerythrol, dithiothreitol or mercaptoethanol. Further additives, such as salts which are known for stabilizing enzymes, can also be used, e.g. calcium or zinc chloride.

Treatment of the wool or hair with a protease may take place in a long or short bath. Treatment is preferably effected by means of impregnation from a short bath, for example by padding, spraying, coating or printing. The protease may be applied from an aqueous medium or from organic solvent, or also as a paste or foam. The goods-to-liquor ratio is conveniently in the range 1:0.7 to 1:10, preferably 1:1 to 1:5 if treatment is continuous, and in the range 1:10 to 1:40 if treatment is from a long bath.

Application of the protease is preferably effected at a temperature between room temperature and 60° C. The treatment liquor or paste is preferably set at a pH value between 4 and 9, especially 5–7, using a commercial buffer.

The protease is conveniently applied in a quantity of 0.1 to 5%, calculated on the dry weight of the wool or hair. When applied by means of impregnation, the protease is applied in a quantity of 0.1 to 2%, corresponding to an enzyme activity of 400 to 1500 CDU/mg (casein digestion units/mg), preferably in a quantity of 0.5 to 1%. When applied from a long bath, the protease is used in a quantity of 1 to 5%, again calculated on the dry weight of the wool.

Directly after the enzymatic treatment, the wool or hair is either left to dwell and/or undergoes thermal treatment. The dwelling period may last from a short interim period to several hours, with partial or complete drying of the goods. Depending on the temperature, the thermal treatment may take place for a few minutes up to several hours, optionally until the wool is dry. Saturated steam, super-heated steam, hot air or high frequency (HF) waves may be used for the thermal treatment. When steaming with saturated steam for example, the wool or hair is advantageously steamed for between 10 and 30 minutes. In the HF drier, the wool or hair is conveniently treated at about 100°–102° C. between 10 minutes and 1 hour. The conditions for the dwelling period or the thermal treatment are chosen such that the wool obtained has the desired properties, and preferably such that the enzyme is simultaneously disactivated at the end of the treatment. Any enzyme that is still active can also be deactivated by known methods after treatment.

The wool or hair is then washed and dried, and further processed.

The process according to the invention may be used both for wool and for other protein-containing animal hairs. The fibre material may exist in various stages of processing, e.g.

in the form of flocks, tops and roving, yarn, knitted goods, woven goods or non-wovens. The wool may be used for the process according to the invention in the raw or pre-treated state.

In order to attain certain effects and/or to optimise the effect of the protease, it may be convenient to carry out special pre-treatments prior to the enzymatic treatment. Suitable pre-treatments for wool or hair may be for example oxidative treatments, e.g. with hydrogen peroxide, optionally in the presence of a stabiliser, with potassium permanganate, nitric acid, Caro's acid, chlorine or chlorine-containing compounds such as chlorine gas, hypochlorites or organic chlorine carriers, or with ozone, reducing pre-treatments, e.g. with hydrosulphite, a sulphoxylate or sulphide, alkaline treatments, pre-treatments with acids, solvents or enzymes such as lipases, catalases, oxidases or peroxidases, or physical treatments, for example with various forms of radiation such as HF waves or cold discharges. These pre-treatments are known and are used in part to modify the wool.

After the pre-treatment, the wool or hair is rinsed and optionally dried.

In a preferred feature of the process according to the invention, the wool or hair is oxidized by chlorination and then treated with a protease.

The oxidative chlorination of the wool or hair is preferably carried out using active chlorine, e.g. in the form of chlorine gas in water or in the form of sodium hypochlorite with hydrochloric acid. This pretreatment may be carried out by known methods. The wool or hair preferably undergoes mild chlorination. The wool or hair is preferably chlorinated with a quantity of 0.1 to 2% of active chlorine, calculated on the dry weight of the wool or hair. This treatment advantageously takes place at a pH of 1.5–3, preferably about 1.8, for 1 to 10 seconds. Chlorination is preferably effected at a temperature of between 10° and 30° C.

According to an alternative preferred embodiment, the wool or hair is oxidized with nitric acid prior to treatment with the protease. Advantageously, the substrate is treated with an aqueous solution of 3 to 15 g/l nitric acid (calculated as 100% acid) to give a pick-up of about 0.2 to 0.7% nitric acid based on the dry weight of the wool or hair. The thus-treated substrate is then heated briefly so that the oxidation is confined to the surface of the fibers, preferably at about 70° to 90° C. More preferably, it is heated by high frequency to about 90° C. and kept at that temperature for a few seconds.

After the pre-treatment, in order to attain the desired enzymatic effect, it is advantageous for the wool or hair to be free from residual pre-treatment agents and to have a pH in a neutral range.

After oxidation, the fibre material is treated so as to be free from residual oxidizing agent, and may be subsequently or simultaneously neutralised. The chlorine or nitric acid present on the fibre or in the fibre is removed by treatment with a reducing agent, for example sodium bisulphite, sodium sulphite etc. Neutralization is advantageously carried out with an alkaline compound, for example an alkali metal carbonate. In accordance with a preferred embodiment the treatment with a reducing agent is followed by treatment with sodium hydrosulfide to sensibilize the wool or hair.

Depending on the chosen conditions of the process, with or without pre-treatment, the scaly layer of the wool or hair is only slightly changed or activated and is physically intact. As a result of the enzyme treatment, wool or hair is obtained which has reduced felt behaviour and does not provoke problems during further processing (spinning, bleaching, dyeing) and during usage and washing of the articles made therefrom. The wool which is treated in accordance with the invention has a soft and, which is particularly advantageous, natural woolly handle. When it is chlorinated as tops and is then treated enzymatically as mentioned above, an especially soft wool or hair is produced. The dyeing behaviour of the wool or hair which is treated according to the invention and the fastness properties of the dyed wool or hair are also not adversely affected.

The following examples illustrate the invention. All percentages are by weight and all temperatures are given in Centigrades.

EXAMPLE 1

Wool tops are padded at 40° with an aqueous liquor which is buffered to pH 6.0 and to which is added, per kg wool, 0.5 l of an aqueous solution containing 10 g/l esperase [Bac. lich., obtainable from Novo (Denmark)] such that after squeezing out to a pick-up of 50% the wool contains 0.5% esperase based on the dry weight of the wool.

The impregnated tops are subsequently steamed for 15 minutes in saturated steam at 102°. After this treatment, the tops are washed out and then dried.

A soft wool which is low in felt and which can be spun with little waste is obtained.

EXAMPLE 2

The process of example 1 is repeated, whereby after padding and squeezing out, the tops are dwelled for about 10 to 30 minutes and then treated for 30 minutes in a HF drier at 100°–102°.

EXAMPLE 3

Wool tops are firstly padded for 3 seconds at a temperature of 10°–20° on a split padder for tops containing, per kg wool, 6 l chlorine water containing 0.67 g/l active chlorine, so that there is available 0.4% active chlorine, based on the dry weight of wool. The wool is subsequently rinsed, then treated for 45 seconds with an aqueous liquor containing 4 g/l sodium carbonate and 1 g/l sodium bisulphite, and washed twice.

After drying, the chlorinated tops undergo enzymatic treatment in accordance with example 1 or 2.

EXAMPLE 4

Wool tops are treated for 60 minutes at 30° with an aqueous bath containing, per liter, 15 ml of aqueous hydrogen peroxide 40% by volume and 3 ml of a commercial silicate-free hydrogen peroxide stabiliser, set at a pH of 5.5–6.0. The liquor-to-goods ratio is 20:1. The tops are then rinsed and subsequently treated enzymatically according to the process of example 1.

EXAMPLE 5

Wool tops are treated for 5 hours at 45° with an aqueous bath containing, per liter, 15 ml of hydrogen peroxide 40% by volume and 4 g of sodium pyrophosphate, set at a pH of 7.5–8.5. The liquor-to-goods ratio is 20:1. The wool is subsequently rinsed and then treated enzymatically as described in example 1.

EXAMPLE 6

Wool tops are treated for 60 minutes at 20° with an aqueous bath containing 6% peroxymonosulphuric acid (Caro's acid). The liquor-to-goods ratio is 20:1. 2% sulphuric acid is subsequently added to the bath, and the wool is treated further with this bath for 30 minutes at 26°. Then, 12% sodium sulphite is added to the bath, and the wool is further treated for 20 minutes at 30°.

After rinsing, the wool is treated enzymatically according to example 1.

EXAMPLE 7

Wool tops are padded at 30° with aqueous liquor containing, per liter, 25 ml of hydrogen peroxide 40% by volume and 25 g/l of potassium persulphate, set at a pH of 7. The pick-up is 60%. After leaving at room temperature for 10 hours, the wool is washed out and subsequently treated enzymatically as described in example 1 or 2.

EXAMPLE 8

Wool tops are treated for 6 hours at 40° with an aqueous bath containing 0.5% of a commercial peroxidase and 0.25 mol/l hydrogen peroxide. The liquor-to-goods ratio is 25:1. The wool is subsequently rinsed and then treated with the esperase as in example 1 or 2.

EXAMPLE 9

Wool tops are treated for 6 hours at 40° with an aqueous bath containing 0.5% of a commercial lipase. The liquor-to-goods ratio is 20:1. The wool is subsequently rinsed and then treated with the esperase as in example 1 or 2.

EXAMPLE 10

Wool tops are padded to a pick-up of 50% with aqueous liquor containing 0.2% of a commercial catalase and 40 ml/l of hydrogen peroxide 40% by volume. The impregnated wool is subsequently left for 6 hours at room temperature and then rinsed.

The pre-treated wool is then treated with the esperase as in example 1 or 2.

A protease such as pancreatin can be used in examples 1 to 10 instead of the esperase. A wool with a soft woolly handle and shrink-resistant properties is obtained.

EXAMPLES 11 AND 12

Examples 1 and 2 are repeated using, instead of 0.5% of esperase, 0.5% of bromelain.

Wool with a soft woolly handle and shrink resistant properties is obtained.

Examples 3 to 10 can be repeated using an appropriate amount of bromelain instead of esperase. Wool with a soft woolly handle and shrink resistant properties is obtained.

EXAMPLE 13

Example 1 is repeated using, instead of esperase, 1% of bromelain which is applied from a long bath with a liquor-to-goods ratio of 20:1. The treatment continues for 4–6 hours at 50°. After rinsing, the wool tops are dried and show a soft woolly handle and good shrink resistance properties.

EXAMPLE 14

Wool tops are pretreated as in Example 3 and after washing, further processed to finished goods. These finished goods can now be treated as in Example 13 and show excellent properties.

EXAMPLE 15

Wool tops are treated at a temperature of 10°–20° C. on a split padder with chlorine water containing sufficient active chlorine such that the wool is chlorinated with 0.3% active chlorine based on the dry weight of the wool. Thereafter, the wool is treated with an aqueous liquor containing 1.5 g/l sodium bisulphite and with an aqueous liquor containing 0.1% (based on the dry weight of wool) of sodium hydrosulfide.

Without rinsing, the wool is dried and then padded with an aqueous liquor containing bromelain in an amount such that 0.4% (based on the dry weight of wool) bromelain is applied to the wool. The wool tops are put in a HF drier at 100°–102° C. and treated for 30 minutes.

EXAMPLE 16

Wool tops are firstly padded for 3 seconds at a temperature of 10°–20° on a split padder containing, per kg wool, 6 l of a solution containing 10 g/l of nitric acid. The wool is subsequently heated up to 90° by high frequency and kept at this temperature for 5 seconds. It is then rinsed with water at 35° and treated for 30 seconds in an aqueous bath at 30° containing 4 g/l sodium carbonate and 1 g/l sodium bisulphite whereafter the wool is rinsed twice again and dryed with hot air.

After drying the pretreated tops undergo enzymatic treatment in accordance with EXAMPLE 1 or 2.

We claim:

1. A composition comprising enzymatically treated wool or animal hair with a substantially intact scaly layer and a low-in-felt or felt-free finish having the following properties:

a) an area of shrinkage which is the sum of the % shrinkage in length and the % shrinkage in width, of <10% after a Cubex test of at least one hour or after 5 cycles 7 A according to IWS Test Method 31, b) a loss of yarn strength, compared with untreated wool or hair, of less than 15%; and a) an elongation which deteriorates by loss than 20%.

2. A process for the production of wool, or protein-containing animal hair, having a low-in-felt or felt-free finish defined by a) an area shrinkage, which is the sum of the % shrinkage in length and the % shrinkage in width, of less than 10% after a Cubex washing test of at least one hour according to IWS Test Method 185 or after 5 cycles 7 A according to IWS Test Method 31, b) a loss of yarn strength, compared with the untreated wool or hair, of less than 15%; and c) a loss of stretching of less than 20%, compared with the untreated wool or hair, which comprises oxidizing the wool or hair by chlorination with an effective oxidizing amount active chlorine and then applying an amount of protease to the wool or the hair by impregnation from a short bath under conditions appropriate to leave the scaly layer of the wool or hair physically intact and, directly thereafter, heating the thus-treated wool or hair for a time sufficient to obtain a low-in-felt or felt-free finish on the wool or hair.

3. The process according to claim 2, wherein the protease used is subtilisin, thermolisin, trypsin, pepsin, pancreatin or bromelain.

4. The wool or animal hair which is produced according to the process of claim 2.

5. The process according to claim 2 which further comprises treating the chlorinated wool or hair with sodium bisulphite and then with sodium hydrosulfide prior to treatment with the protease.

6. The process according to claim 2 wherein the treatment with high frequency waves is carried out for 10 minutes to one hour.

7. The process according to claim 2 wherein the protease is applied in a quantity of 0.1 to 2%, calculated on the dry weight of the wool or hair, corresponding to an enzyme activity of 400 to 1500 CDU/mg.

8. The process according to claim 7 wherein the wool or hair is rinsed and dried after the oxidizing step.

9. The process according to claim 7 wherein the protease is bromelain.

10. The process according to claim 2 wherein the chlorination is effected with chlorine gas in water or with sodium hypochlorite and hydrochloric acid.

11. The process according to claim 10 wherein oxidation is effected by chlorination with 0.1 to 2% active chlorine based on the dry weight of the wool or hair.

12. The process according to claim 11 wherein the chlorination is effected at a pH of 1.5 to 3 for 1 to 10 seconds.

13. The process according to claim 12 wherein the chlorination is effected at a temperature between 10° and 30° C.

14. The process according to claim 2 wherein the protease is bromelain.

15. The process according to claim 2 wherein the protease is applied at a temperature between room temperature and 60° C. and a pH between 4 and 9.

16. The process according to claim 15 wherein the protease is applied at a pH of 5 to 7.

17. The process according to claim 2 wherein the chlorination is effected at a pH of 1.5 to 3 for 1 to 10 seconds.

18. The process according to claim 2 wherein the area shrinkage is <10% after 2 cycles 5 A according to IWS Test Method 31.

19. A process for the production of wool, or protein containing animal hair, having a low-in-felt or felt-free finish which comprises oxidizing the wool or hair with an effective amount of an oxidizing agent and then applying an amount of protease to the wool or the hair by impregnation from a short bath under conditions appropriate to leave the scaly layer of the wool or hair physically intact and, thereafter, heating the thus-treated wool or hair for a time sufficient to obtain a low-in-felt or felt-free finish on the wool or hair.

20. The process according to claim 19 wherein the wool or hair is rinsed and dried after the oxidizing step.

21. The process of claim 19 wherein the oxidizing agent comprises nitric acid.

* * * * *